United States Patent [19]

Hertzler

[11] 4,217,809

[45] Aug. 19, 1980

[54] BULLET SIZING AND LUBRICATING SYSTEM

[76] Inventor: Bruce Hertzler, Rte. 5, Box 5400, Albuquerque, N. Mex. 87123

[21] Appl. No.: 867,818

[22] Filed: Jan. 9, 1978

[51] Int. Cl.[2] ..... F42B 31/02

[52] U.S. Cl. ..... 86/19; 74/820; 86/23; 86/27

[58] Field of Search ..... 86/19, 23, 27; 74/820

[56] References Cited

U.S. PATENT DOCUMENTS

| | | | |
|---|---|---|---|
| 3,005,372 | 10/1961 | Hall | 86/19 |
| 3,279,281 | 10/1966 | Anderson et al. | 74/820 |
| 3,605,517 | 9/1971 | Seragnoli | 74/820 |
| 3,855,873 | 12/1974 | Fletcher | 74/820 |
| 3,967,526 | 7/1976 | Leieh | 86/19 |

*Primary Examiner*—Harold J. Tudor
*Attorney, Agent, or Firm*—Walter R. Keller

[57] ABSTRACT

In a system which sizes and lubricates lead bullets, an indexing plate, being chain driven, and having an indexing post, is mounted horizontally and in such a manner that the indexing post engages indexing detents in a transfer plate, having a plurality of bullet receiving holes. The transfer plate also mounted horizontally, and which has circular scallops whose radii and centers of curvature are coincident with the contacting surface of the indexing plate, providing an indexing to the transfer plate and a positive lock in between index positions; and a lubricating mechanism using a harmonic motion thus providing a lubricating piston with a long time in which to exert nearly maximum pressure on the lubricant and thereby optimizing the lubricating stroke; all being properly timed with the proper movement of the punch; so as to provide simultaneous and high speed sizing and lubricating of bullets.

3 Claims, 5 Drawing Figures

BULLET SIZING AND LUBRICATING SYSTEM

BACKGROUND OF THE INVENTION

1. Field of the Invention

This invention relates primarily to a system which automatically feeds lead bullets to a die through which they are sized and simultaneously lubricated.

2. Description of Prior Art

In prior art, a machine of very old design, unpatented, is used to size and lubricate lead bullets. The old machine was driven by a constant speed electric motor through a V-belt. The shaft then drove a punch, a transfer bar, and the lubricating mechanism. The transfer bar, which had a single bullet receiving hole, reciprocated so that the bullet receiving hole alternately was under a feed tube, on one end of the reciprocating stroke, and over the die and under the punch at the other end of the reciprocating stroke. The mechanism driving the transfer bar limited the speed of the machine considerably. The lubricating means consisted of two spring loaded levers, actuated by a cam on the shaft. One of the spring loaded levers operated a lubricating piston in a cylinder which simply was driven in a linear shuttle motion, and the other spring loaded arm operated a lubricant feed value. The lubricating mechanism provided essentially no dwell time at the ends of piston travel, thus the lubricant had little opportunity to feed in the piston cylinder, nor time to be forced from the cylinder to ports in the die to lubricate the bullet. Consequently, the quality of lubrication of the bullets was poor and excess lubricant frequently was discharged into the die causing a dirty messy work area underneath the machine.

SUMMARY

The invention is a system which simultaneously feeds, sizes, and lubricates lead bullets. The invention has an indexing mechanism, a transfer plate, a punch, and a die with ports through which lubricant is forced as the bullet passes through the die, thus lubricating and sizing the bullet simultaneously. The lubricating piston is driven by a device, which imparts a harmonic motion to the lubricating piston.

An object of the invention is to provide a self locking indexing and transfer means on a rotary motion, rather than linear and thereby increase the speed of the operation. Another objective is to provide a lubricating mechanism which provides a long pressurized period thus insuring a high quality of lubrication. A further objective is to provide a lubricating mechanism which does a superior job of lubricating bullets without an improvement in performance. To do this it is necessary to drive all the mechanism from a common gear box, thus insuring a common source of motion as a single basis for all timing functions.

DESCRIPTION OF THE PREFERRED EMBODIMENT

Figure 1:
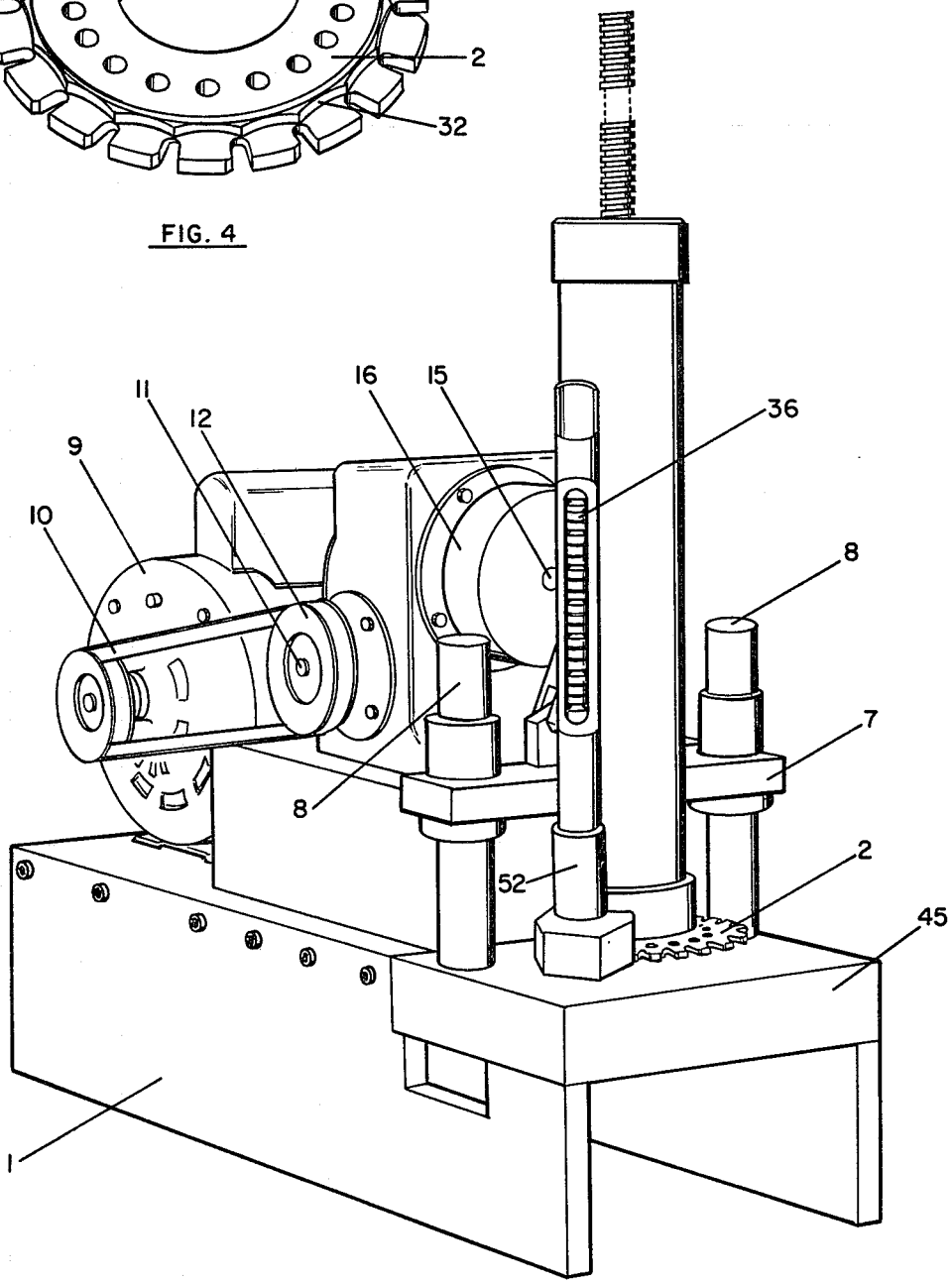
FIG. 1 is an isometric view of the invention seen from the left front.
Figure 2:
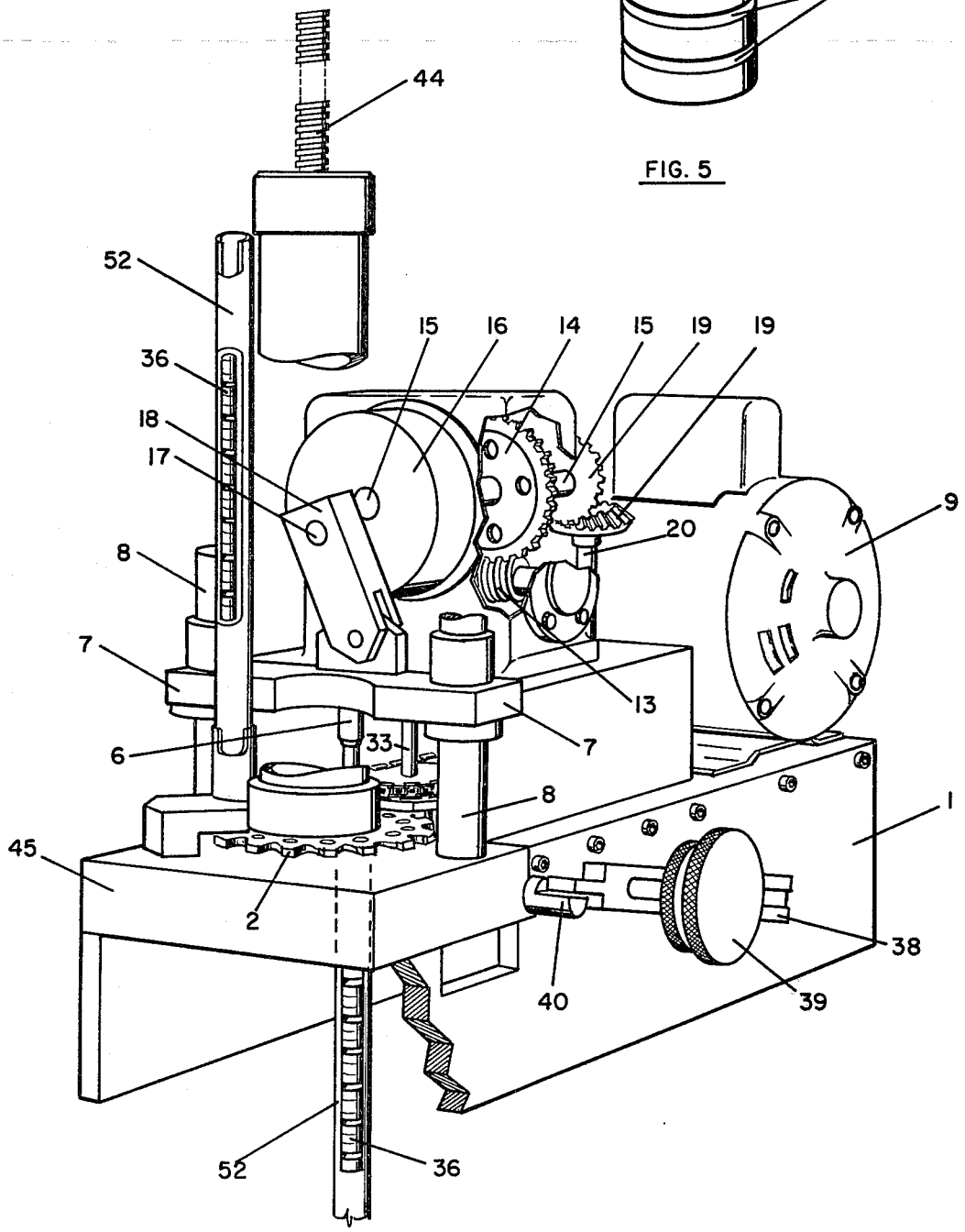
FIG. 2 is an isometric view of the invention seen from the right front.

Referring to the drawings, FIG. 1 shows the invention having bolted base 1, a transfer plate 2, and guide posts 8. The invention is driven by a standard constant speed electric motor 9 which, through V-belt 10, supplies power to a drive shaft 11. The drive shaft 11 has on one end a V-belt pulley 12 to fit V-belt 10, and on the other end a worm 13, as shown in FIG. 2. Power is transmitted by means of a worm gear 14 to a horizontal drive shaft 15. On one end of the horizontal drive shaft 15, fixedly attached thereto, is the punch drive wheel 16 to which the horizontal drive shaft 15 imparts a rotary motion. Eccentrically located on the face of the punch drive wheel 16 in a punch throw pin 17, which pivotably attaches one end of a punch throw rod 18 to the punch drive wheel 16. The other end of the punch throw rod 18 is pivotably attached to the punch yoke 7. The punch drive wheel 16, punch throw pin 17, and punch throw rod 18 impart a harmonic motion to the punch yoke 7 whose movement is constrained to a vertical reciprocating motion.

Figure 3:
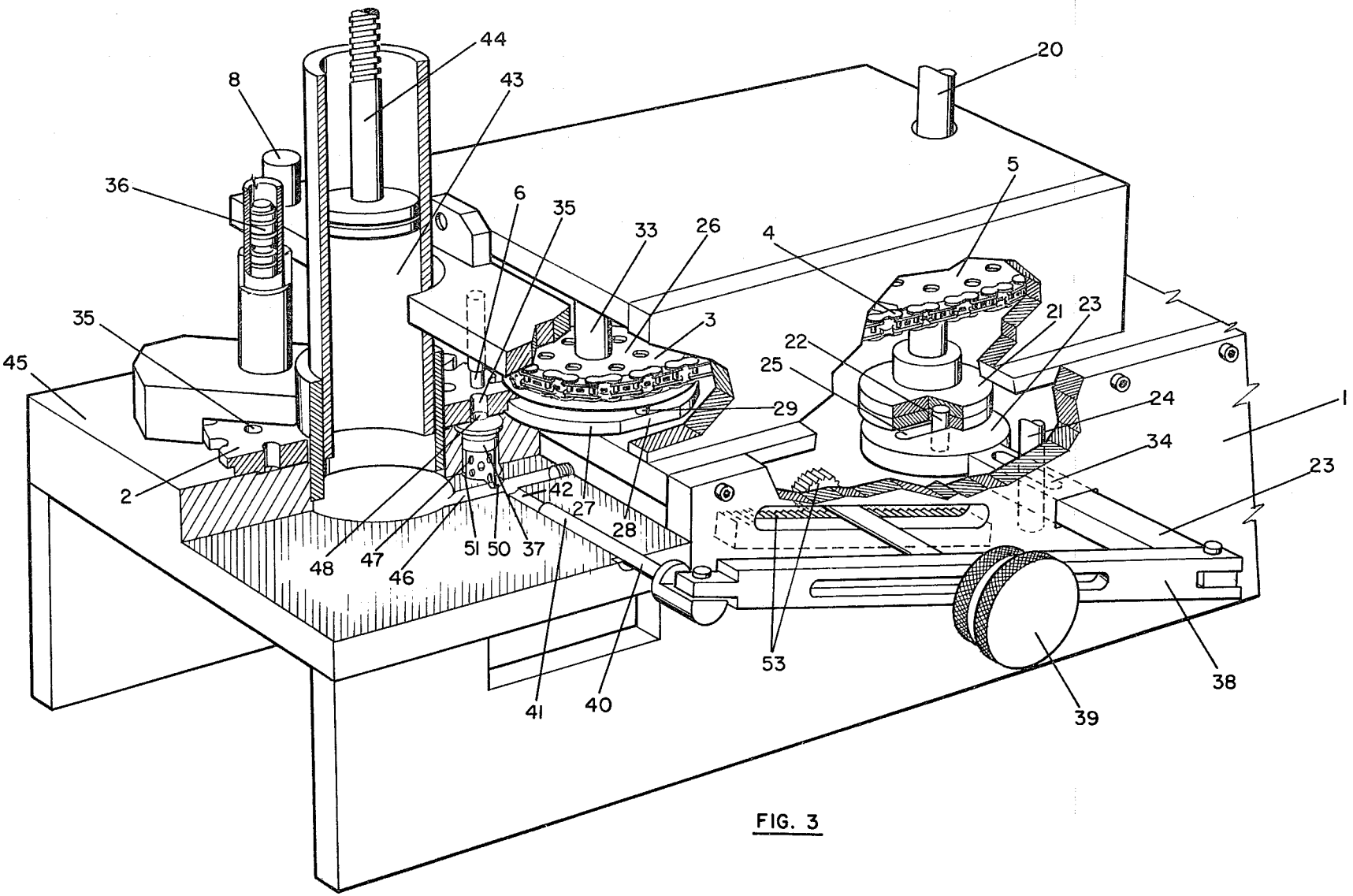
FIG. 3 is a isometric view of the invention from the right front with cut aways to show inner mechanisms.

Still referring to FIG. 2, power is also transmitted from worm 13 by means of the mating worm gear 14 to the other end of the horizontal drive shaft 15 which has fixedly attached thereto a bevel gear 19 which mates with another bevel gear 19 on a vertical drive shaft 20. As shown in FIG. 3 mounted fixedly on the vertical drive shaft 20, near the mid-point of its length, is power sprocket 5; and fixedly mounted on the other, lower end of the vertical drive shaft 20 is the lubricating drive wheel 21. The lubricating drive wheel 21 on its lower face has fixedly mounted, eccentrically, a lubricating drive pin 22 which slideable attaches a lubricating crank 23 to the lubricating drive wheel 21. The lubricating crank 23 is slideable constrained to linear motion by a crank guide 24, which is rigidly attached to the bolted frame 1. As the lubricating drive pin 22 rotates on the lubricating drive wheel 21, the lubricating drive pin 22 also slides in a pin slot 25 in the lubricating crank 23 imparting only harmonic reciprocating motion to the lubricating crank 23.

Figure 4:
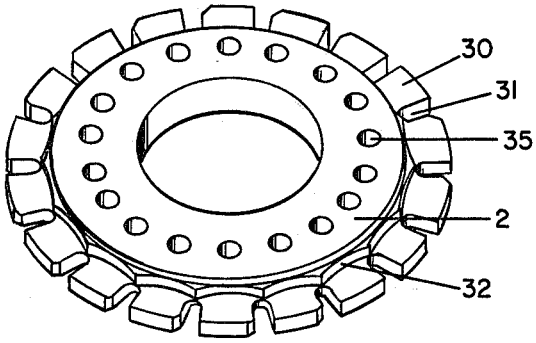
FIG. 4 is an isometric view of the transfer plate inverted to show the bottom of the transfer plate.

As shown in FIG. 3, the indexing plate 3 is generally shaped like a spool with two flanges. The upper flange is an indexing sprocket 26 which receives and is driven by a chain 4. The lower flange is a smooth circular locking surface 27, except for an indexing cut out 28. Mounted vertically between the flanges in the area of the indexing cut out 28 is an indexing bar 29. As shown in FIG. 4, the transfer plate 2 consists of a thick cylindrical plate whose cylindrical side is cut and machined to have unique surfaces. The upper cylindrical surface is shaped similar to a sprocket, having fingers 30 and notches 31, around the circumference. The lower cylindrical surface is shaped to have a plurality of circular scallops 32 around the circumference; the radius of each circular scallop 32 being the same as the radius of the circular looking surface 27. The indexing plate 3 is rotatably mounted on a vertical indexing plate axle 33 which is rigidly attached to a die base 45 which in turn is rigidly attached to the bolted frame. The transfer plate 2 is rotatably mounted on die base 45.

The transfer plate 2 and the indexing plate 3 are disposed with respect to each other so that the scallops 32 on the transfer plate 2, slideably mate with the circular locking surface 27 on the indexing plate 3. As the indexing plate 3 turns, the indexing bar 29 engages the cam surfaces of the fingers 30 and notches 31; and, while the indexing cut out 28 addresses the scallops 32, the indexing bar 29 turns the transfer plate 2, through an arc equal to the angular displacement of one finger 30 to another adjacent finger 30. Whereupon, the circular locking surface 27 of the indexing plate 2, locking the transfer plate 2 into a stationary position until the indexing plate 3 completes one revolution and the process is repeated indexing the transfer plate 2 to the next position. The transfer plate 2 has a plurality of bullet receiving holes 35 position angularly about the transfer plate 2 so that when the transfer plate 2 is locked into stationary position, a bullet 36 in the bullet receiving hole 35 is disposed vertically above a die 37, and below the punch 6. Bullets 36 are fed into the bullet receiving holes 35 from a pre-loaded tube 52 by the force of gravity.

Figure 5:
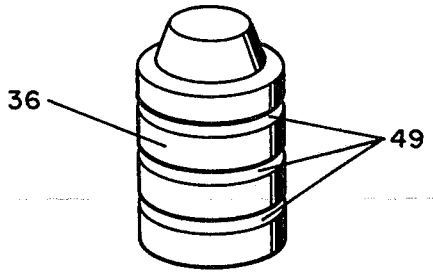
FIG. 5 is an isometric view of a bullet.

As shown FIG. 3 the lubricating crank 23 is slideably attached to the lubricating drive wheel 21 by the lubricating drive pin 22 which passes through the pin slot 25 in the lubricating crank 23. Approximately midway its length, the lubricating crank 23 is slideably constrained to a linear reciprocating motion by the crank guide 24, and crank guide slot 34 in the lubricating crank 23. The other end of the lubricating crank 23 is pivotably attached to one end of a lubricating lever 38. The lubricating lever 38 is pivotably attached near its mid-point to a lever fulcrum 39 which in turn is attached adjustably to the bolted frame 1, by pinon rack and gear 53. The other end of the lubricating lever 38 is pivotably attached to one end of lubricating piston rod 40. The other end of the lubricating piston rod 40 acts as a piston 41, which slides in a cylinder 42 in the die base 45. The lubricating drive wheel 21, lubricating drive pin 22, lubricating crank 23, lubricating lever 38, lever fulcrum 39, and piston rod 40 impart a harmonic reciprocating motion to the lubricating piston 41. A supply of lubricant in the lubricant chamber 43 is placed under pressure by exerting a force on the lubricant with a pressure piston 44 which is manually screwed down on to the lubricant. It is realized that there are many and varied means for pressurizing the lubricant such as pressurized gas, displacement pumps, hand pumps, and the like all of which are within the contemplation of this invention. The pressurized lubricant is forced from the lubricant chamber 43 into a lubricant feed bore 46 in the die base 45 which discharges into the cylinder 42. The die 37 has lubricating ports 47 disposed circumfrentially around a sizing hole 48 in the die 37. The lubricating ports 47 are also disposed vertically to match the lubricating grooves 49 in the bullet 36, shown in FIG. 5. Referring again to FIG. 3, from the cylinder 42, a lubricant discharge bore 50, connects to a lubricant manifold 51 which in turn connects to the lubricating ports 47. As the lubricating piston 41 begins its travel, lubricant is fed from the lubricant chamber 43 through the lubricant feed bore 46 into the cylinder 42. The lubricating piston 41 then closes off the lubricant feed bore 46 shutting off the supply of lubricant as the lubricating piston 41 travels toward the die 37. Further travel of the lubricating piston 41 applies pressure to the lubricant, forcing it from the cylinder 42 through the lubricant discharge bore 50, into and through the lubricant manifold 51, and out the lubricant ports 47 in the die 37 onto and around the grooves 49 in the bullet 36 filling the grooves 49. Thus, the lubricating piston 41 both measures, and delivers the lubricant. The harmonic motion of the lubricating piston 41 provides slow displacement during the filing of the cylinder 42 with lubricant, and during the high pressure lubricant delivery portion of its stroke, thus insuring sufficient time for the viscous lubricant to fill the grooves 49 in the bullet 36.

As shown in FIG. 3, the die 37 is mounted in the die base 45 directly below a bullet receiving hole 35 in the transfer plate 2, and directly under the punch. After the indexing plate 3 properly positions and locks the transfer plate 2 with a bullet 36 in the aligned bullet receiving hole 35, the punch 6, begins its delivery stroke. As the punch 6 forces the bullet 36 through the die 37, the bullet 36 is simultaneously sized and lubricated. The sized and lubricated bullets 36 are collected upon ejection in a tube 52, ready to be fed into a loading machine; tube 52 being indentical with the pre-loaded tube 52.

Proper timing of the invention is controlled by utilizing a common source of motion, proper division of power through the ratio of gear teeth on the bevel gears 19 and the ratio of the number of teeth on the power sprocket 5 and indexing sprocket 26, all as determined by standard kinematics. As used in this description, the bevel gears 19 have a ratio of one as is the ratio of sprockets 5 and 26. The stroke of the lubricating piston 41 is adjustable in a variety of ways. First the lubricating drive pin 22 may have a variety of positions on a radius of the lubricating drive wheel 21, thus varying the displacement of the lubricating crank 23. Second, the length of the lubricating crank 23 can be adjustable, as can be the length of piston rod 40, both of which adjustments will determine the null points of lubricating piston 41 travel. The position of the lever fulcrum 39 can be adjusted along the length of the lubricatng lever 38, thus varying the ration of distance traveled by piston 41 to the distance traveled by the lubricating crank 23. As described, the invention has operated at 25,000 bullets per hour.

I claim:

1. A system for simultaneously sizing and lubricating lead bullets comprising:

a bolted frame, which supports an electric constant speed motor, which drives a V-belt which drives a worm gear on a drive shaft, and said bolted frame supporting a die base having therein a die; and, a bevel gear fixedly attached to the drive shaft, a mating bevel gear fixedly attached to vertical drive shaft, which has at its approximate mid-point a power sprocket, an indexing plate generally shaped like a spool having two flanges, the upper flange being an indexing sprocket driven by a chain which in turn is driven by the power sprocket, and the lower flange of the indexing plate being a circular locking surface, except for an indexing cut out, and the indexing plate having an indexing bar between the two flanges in the vicinity of the indexing cut out, and the indexing plate being rotatably mounted to the die base, and a transfer plate having the shape of generally a cylindrical plate whose cylindrical surface is machined so that the upper portion of the cylindrical surface has a plurality of finger and notches which mate with the indexing bar, and the lower portion of the cylindrical surface, having scallops whose radii of curvature is the same as the radius of curvature of the locking surface of the indexing plate and the transfer plate having a plurality of bullet receiving holes, in its upper plate surface disposed so that when the transfer plate is locked into a stationary position one bullet receiving hole is deposed between a punch and said die, and upon being indexed by the indexing plate the next bullet receiving hole is moved to and locked in a position between the punch and die, and the transfer plate being rotatably mounted on the die base;

a means for rapidly driving the punch which forces the bullets through a die, said means being driven by a punch drive wheel fixedly attached to the drive shaft and a means positively driven by said bevel gear fixedly attached to the drive shaft, for rapidly forcing the lubricant from a lubricant pressurized supply to the bullet as it passes through the die without waste of lubricant, wherein the drive shaft provides a common source of motion and division of power to the means for rapidly driving the punch, the means for rapidly forcing the lubricant to the bullet, and to the indexing plate, thereby insuring proper timing.

2. The system of claim 1 wherein the means for rapidly driving a punch which forces the bullets through a die comprises:

a punch drive wheel fixedly attached to the drive shaft, a punch throw pin eccentrically located on the face of the punch drive wheel, a punch throw rod pivotably attached to the punch drive wheel by the punch throw pin, and pivotably attached to a punch yoke, two guide posts, vertically mounted on a die base, on which the punch yoke is slideably mounted, constraining the motion of the punch yoke to a reciprocating vertical motion, and a punch fixedly attached to the punch yoke.

3. The system of claim 1 wherein the means for rapidly forcing the lubricant from a pressurized lubricant supply to the bullet as it passes through the die without waste of lubricant comprises:

two mating bevel gears, one fixedly attached to the drive shaft, and the other fixedly attached to a vertcal drive shaft, a lubricating drive wheel fixedly attached to the lower end of the vertical drive shaft, a lubricating drive pin eccentrically mounted on the lower face of the lubricating drive wheel, which slideably attaches a lubricating crank to the lubricating drive wheel, by passing through a pin slot in the lubricating crank, providing a harmonic reciprocating motion to the lubricating crank, a crank guide fixedly attached to the bolted frame which passes through a guide slot, in the lubricating crank which constrains the motion of the lubricating crank to a linear reciprocating motion, a lubricating lever pivotably attached on one end to the lubricating crank, and which is attached adjustably near its mid-point to a lever fulcrum also adjustably mounted on the bolted frame, a piston rod, pivotably attached to one end of the lubricating lever, and having one end function as a lubricating piston, a cylinder in the die base in which the piston rod slideably reciprocates, a lubricating feed bore in the die base, through which pressurized lubricant passes, from the pressurized lubricant suply chamber to the cylinder, a lubricant discharge bore which provides a passage from the cylinder to a die, the die through which bullets to be sized are forced by the punch, which has a pluralility of lubricant ports, alligned with lubricant grooves in the bullet, connecting with the lubricant discharge bore, the lubricating drive wheel, lubricating drive pin, lubricating crank, lubricating lever, lubricating fulcrum, piston rod, and piston all being connected as described, so that the piston alternately opens and lubricant feed bore thus allowing pressurized lubricant to enter the cylinder, then closing the lubricant feed bore and forcing the lubricant through the lubricant ports in the die on to the lubricant grooves in the bullet as it passes through the die.

* * * * *